US005238048A

United States Patent [19]

Hackman

[11] Patent Number: 5,238,048

[45] Date of Patent: Aug. 24, 1993

[54] ROUND WIRE FROM STRIP

[75] Inventor: Lloyd E. Hackman, Worthington, Ohio

[73] Assignee: Ribbon Technology Corporation, Gahanna, Ohio

[21] Appl. No.: 815,760

[22] Filed: Jan. 2, 1992

[51] Int. Cl.[5] ..... B22D 11/06; B22D 23/06

[52] U.S. Cl. ..... 164/463; 164/80; 164/423; 164/469; 164/471; 164/506; 164/507

[58] Field of Search ..... 164/463, 462, 469, 471, 164/479, 506, 507, 80, 423, 429, 417

[56] References Cited

U.S. PATENT DOCUMENTS

| | | | |
|---|---|---|---|
| Re. 33,327 | 9/1990 | Hackman et al. . | |
| 3,710,842 | 1/1973 | Mobley et al. . | |
| 3,838,185 | 9/1974 | Maringer et al. . | |
| 4,665,970 | 5/1987 | Ohno | 164/471 |
| 4,719,964 | 1/1988 | Sato et al. | 164/463 |
| 5,027,886 | 7/1991 | Strom-Olsen et al. | 164/463 |

FOREIGN PATENT DOCUMENTS

| | | | |
|---|---|---|---|
| 57-139450 | 8/1982 | Japan | 164/463 |
| 1-208428 | 8/1989 | Japan | 164/122.1 |

*Primary Examiner*—J. Reed Batten, Jr.
*Attorney, Agent, or Firm*—Frank H. Foster

[57] ABSTRACT

An apparatus and method for forming round wire from non-round wire has: a heat extracting drum having a semi-circular channel formed in and entirely around its outer circumferential surface; a feed device for directing a precursor wire into the channel; and a heater for melting the precursor wire in the channel. The wire is typically flat and is stood up on edge, perpendicular to the surface of the drum, melted with the heater, solidified and removed. The surface tension and wetting characteristics of the liquid metal cause it to "bead up", forming a near round wire when solidified.

15 Claims, 2 Drawing Sheets

ROUND WIRE FROM STRIP

TECHNICAL FIELD

This invention relates to methods and means for forming wire of a particular cross-sectional shape, specifically wire that is circular or near circular in section.

BACKGROUND ART

There are circumstances in which round wire, that is wire which has a circular cross-section, is preferred over wire which is not round. This preference may be due to the use of the wire in machines which can only use round wire and would be too expensive to alter for other wire, for example, welders. The preference for round wire may also be due to the desire for properties which do not vary depending on the direction of use. For example, flat wire will bend easier in one direction than another, whereas round wire bends the same in all directions.

Conventional round wire is typically formed by drawing a large piece of metal in tension through a die, stretching it to a smaller diameter. The metal being drawn must be ductile enough to undergo the large deformations involved in drawing or else it will break rather than stretch. Conventional wire may also be formed by casting wire from molten metal directly into its final shape. However, the casting of wire, for example, pouring molten metal directly into a groove on a spinning disk as is done in the prior art, requires metering the amount of liquid being poured through a nozzle to get a wire of continuous diameter. One such system is described in U.S. Pat. No. 3,710,842.

Unfortunately, some metals and alloys which are desirable as round wire are brittle, precluding them from being drawn into wire in the conventional way. Additionally, casting involves flow metering of the metal through a nozzle to avoid variations in the diameter of the wire, which is difficult to do successfully.

One method for forming wire which is brittle when solidified is to bring the molten metal into contact with a heat extracting, rotating drum to which rapidly solidified metal adheres and is drawn away from the liquid metal, forming a wire. However, wire formed by this rapid solidification method is usually rectangular in cross-section, not round. Two methods for forming wire in the above described manner are melt overflow and melt extraction. Maringer et al., in U.S. Pat. No. 3,838,185, and Hackman et al., in U.S. Pat. No. Re 33,327 which is a reissue of U.S. Pat. No. 4,813,472, describe the melt overflow and melt extraction methods.

Therefore, the need exists for means and methods by which round wire can be formed of brittle metals, and which do not require difficult flow metering.

SUMMARY OF INVENTION

The invention is a wire forming apparatus and method. The apparatus comprises a continuously advancing, heat extracting substrate which has a channel formed in its surface. It has a stock feeding means for continuously feeding a solidified metal strip into the advancing channel and a heating means, spaced from the channel, for melting the advancing metal strip in the channel. To practice the method of the invention, a precursor metal strip is fed into an advancing channel which has been formed on a heat extracting substrate. The precursor metal strip is fed into the channel at substantially the same velocity as the advancing substrate. The advancing strip is then heated and melted to both effect the flow of metal into the channel and effect the support of the metal by the channel. The molten metal is then resolidified in the channel to form a wire and the solidified wire is then removed from the substrate.

Figure 3:
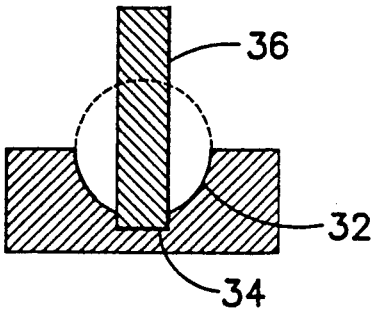
Figure 4:
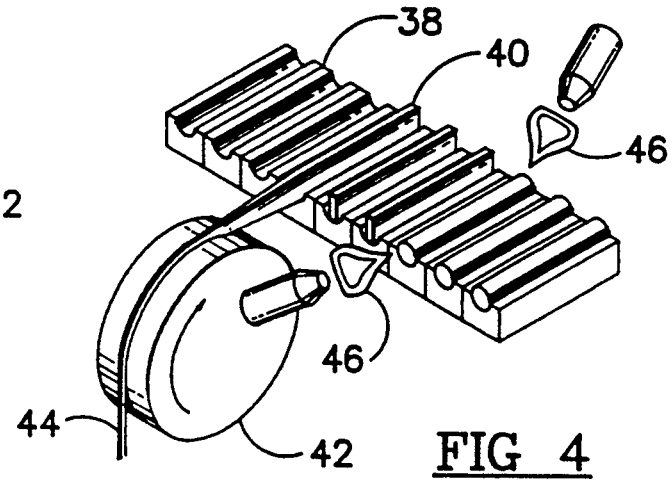
Figure 5:
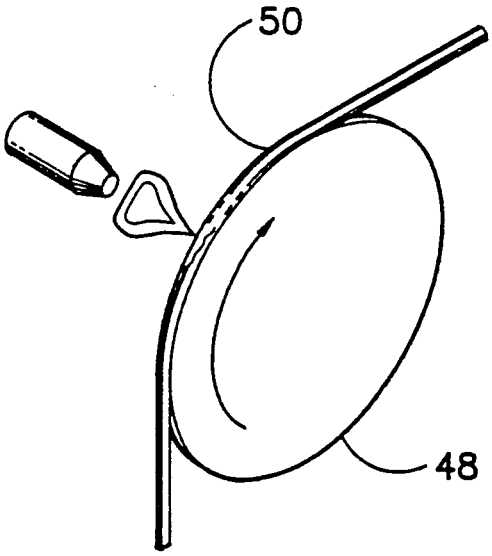
Figure 6:
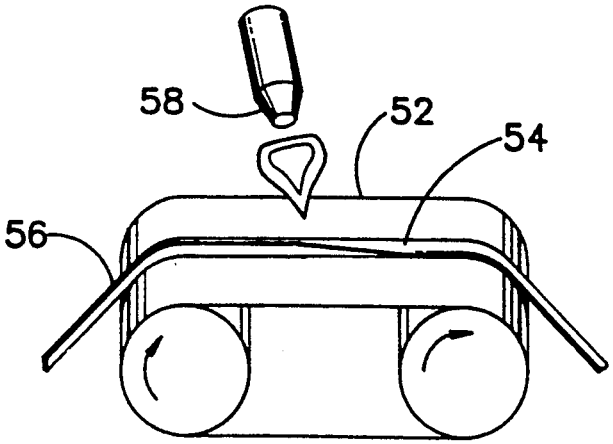

FIGS. *2a, 2b, 2c, 2d* and *2e* are end views in section illustrating the process of melting the wire strip and forming a round cross-section wire;

FIG. 3 is an end view in section illustrating a secondary channel formed within the primary channel;

FIG. 4 is a view in perspective illustrating an alternative embodiment of the present invention;

FIG. 5 is a view in perspective illustrating an alternative embodiment of the present invention; and FIG. 6 is a view in perspective illustrating an alternative embodiment of the present invention.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose.

DETAILED DESCRIPTION OF THE PREFERRED EMBODIMENTS

Figure 1:
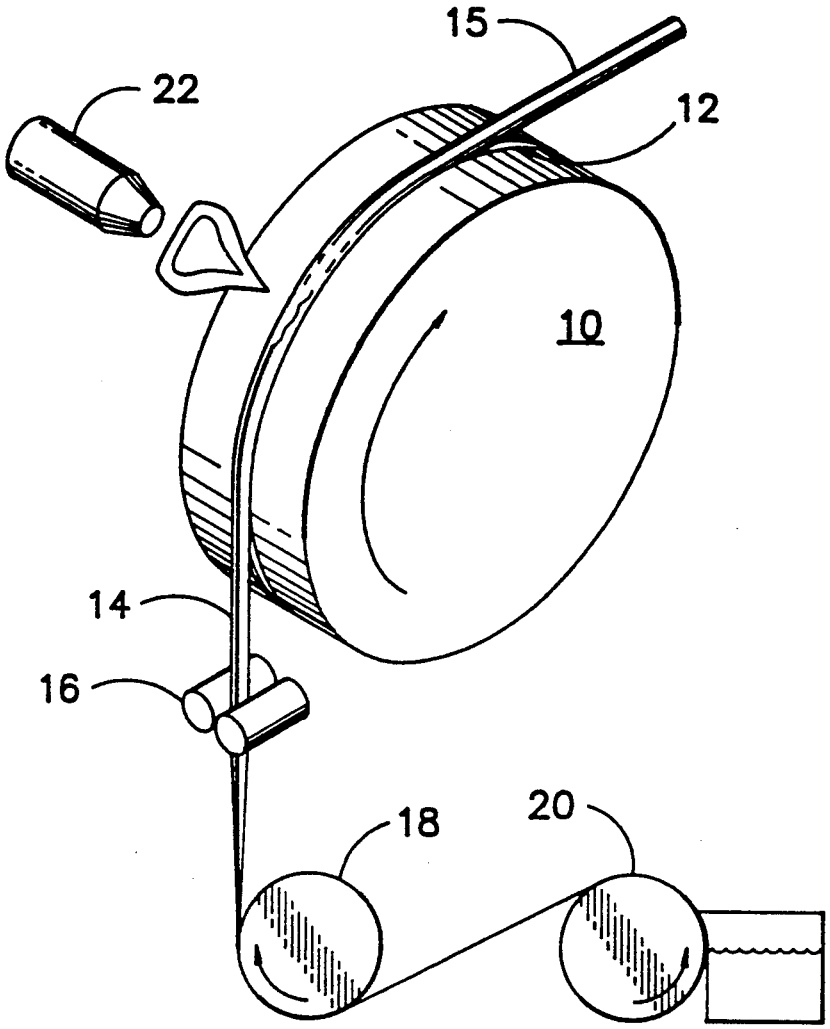
FIG. 1 is a side view illustrating a preferred embodiment of the present invention.

The preferred embodiment of the present invention is illustrated in FIG. 1. A rotating, heat extracting substrate, which is preferably a cylindrical drum 10, rotates about its axis and is preferably attached to a suitable, non-moving, support structure. On the circumferential surface of the drum 10, a channel 12 is formed extending entirely around the drum 10. The channel 12 is preferably semi-circular in cross-section, and has a constant radius around the entire drum 10. A generally rectangular cross-section precursor wire 14 is guided onto the drum 10 and into the channel 12 by guide means 16. The guide means 16 orients the precursor wire 14 perpendicular to the circumferential surface of the drum 10 and positions the precursor wire 14 into the channel 12 in its perpendicular position, in the preferred embodiment. The guide means 16 may be a plurality of opposed cylindrical bearing surfaces between which the wire 14 is fed, and which rotate or bend the wire while directing it to the drum 10.

The precursor wire 14 is preferably transported directly from a melt overflow or melt extraction drum 20 and is fed by a feeding drum 18 to the drum 10. The number of guides or drums used to direct the wire is not critical as long as the wire is directed from the melt overflow or melt extraction drum 20 eventually to the drum 10, with maximum thermal energy retained.

A heating means, preferably a torch 22, is directed toward the channel 12 on the drum 10 for heating the precursor wire 14 as it is advanced past the torch 22. The torch 22 is preferably positioned radially outward from the drum and directed onto the precursor wire 14.

The invention operates in the following manner. A flat wire strip 14 is formed by a rapid solidification process and is guided from the rapid solidification drum 20, through the guide means 16 and into the channel 12 where it is perpendicular to the surface of the drum.

As the flat precursor wire 14 approaches the torch 22, and is heated by it, the temperature of the wire 14 gets high enough that it begins to melt. This is the beginning of the "melt region". This region may begin before the wire 14 is directly underneath of the torch 22 since the wire 14 is hot coming directly from the rapid solidification process, in addition to being heated by the approaching torch 22. As the wire 14 advances closer to the torch 22, it melts further and fills in the channel 12. When the wire 14 is directly under the torch 22, it is completely melted into a pool of liquid which fills the channel 12 and mounds or "beads" up above the surface of the drum 10. This bead is formed from the surface tension of the liquid metal which is discussed below. Rather than overflowing out of the channel 12 onto the drum 10, the liquid metal "beads up" in the channel, forming a generally circular cross-sectional pool of metal. As the drum 10 advances the metal away from the torch, the metal quickly solidifies, forming a near round wire 15. Once the metal has solidified, it exits the "melt region".

The cross-sectional area of the near round wire 15 is preferably equal to the cross-sectional area of the precursor wire 14. Therefore, no tension, which would cause elongation and a decrease in cross-sectional area, is exerted on the metal in its liquefied state.

The flat precursor wire 14 which is directed from the rapid solidification process is preferably still very hot when it is re-melted by the torch 22. Maintaining the high temperature of the precursor wire 14 during transit reduces the amount of thermal energy needed to be applied later to the wire to melt it. This saves the energy required to reheat the precursor wire 14 from far below its melting temperature with the torch 22.

There are shapes other than a flat strip into which the rapid solidification system can form wire. These wires may be kidney or oval shaped in cross-section and can easily be accommodated by the present invention by slightly altering the feed means and other components.

Figure 2A:
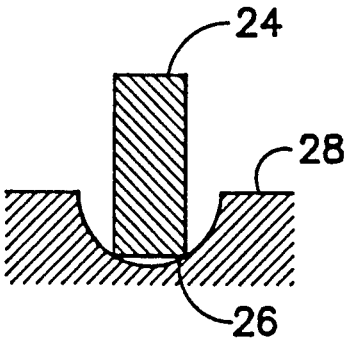
Figure 2B:
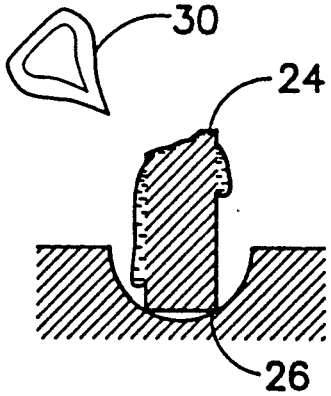
Figure 2C:
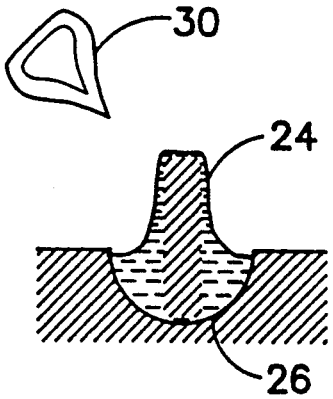
Figure 2D:
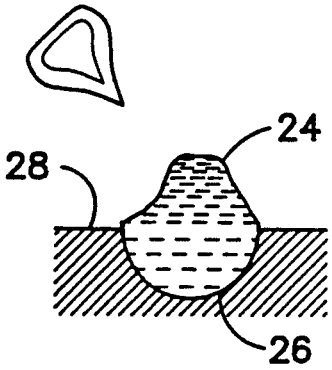

FIGS. 2*a* through 2*e* illustrate the series of steps that occur when a precursor wire 24 melts and forms a near round wire 25 in a channel 26. In FIG. 2*a*, the wire 24 is shown in the channel 26 perpendicular to surface 28 of a drum. In FIG. 2*b*, a torch 30 applies heat to the wire 24, causing it to melt downward in FIG. 2*b* into the channel 26. In FIG. 2*c*, the torch 30 continues to melt the wire 24, forming a substantial pool of liquid in the channel 26. In FIG. 2*d*, the wire 24 continues to be heated and the top surface of the pool of liquid in the channel 26 rises above the surface 28.

The liquid rises above the surface 28 without overflowing out of the channel 26 due to wetting characteristics of the liquid and the substrate, the drum. The wetting angle, for example, determines the radius of curvature of the top surface of the liquid. The wetting characteristics are dependent upon the relative sizes of intermolecular cohesive and adhesive forces between the alloy and the substrate, which are material properties.

Figure 2E:
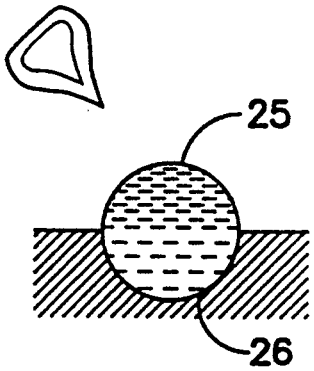

In FIG. 2*e*, the metal is completely liquefied and has formed a near round wire 25 in the channel 26. This is comparable to the state of the metal when it is in the most intensely heated region, that is, directly below the torch 30.

The channel 26 is designed to hold the liquefied metal and give it a generally circular cross-section of virtually the same cross-sectional area as the precursor wire 24. The channel 26 is designed considering the factors affecting wetting characteristics which affect the radius of the liquid when contained within the channel 26.

FIG. 3 illustrates an alternative channel 32 which has a secondary channel 34 formed in its deepest region which is shaped to matingly engage a rectangular cross-section precursor wire 36. The primary purpose of the secondary channel 34 is to hold the precursor wire 36 perpendicular to the surface of the drum while it is being advanced toward the heating means where it will be melted as previously described. The secondary channel 34 will cause the formation of a small rib on the outside of the solidified, near round wire. This rib may be removed later by a conventional process such as shearing or machining to attain the desired round cross-section. However, in some instances, the small rib formed in the secondary channel 34 may not interfere with the use of the wire due to larger tolerances sometimes present in machines which use round wire.

FIG. 4 shows an embodiment which is an alternative to the continuous, advancing surface. It has a block 38, having a channel 40 formed in it and is advanced laterally with respect to a rotating drum 42. The rotating drum 42 deposits a precursor wire 44 onto the block 38 until the wire 44 fills the channel 40 in the block 38, at which time the wire 44 is cut and begins to fill the next channel in the next, advancing block. The precursor wire 44 in the channel 40 is positioned under a heating means 46 which melts the wire 44, causing it to fill in the channel 40 and "bead up" to form a near round cross-section wire as previously described.

FIG. 5 shows an alternative embodiment in which a disk 48 has a channel 50 formed .in its outer circumferential surface. The disk 48 is very similar to the drum 10 of FIG. 1 except that the disk 48 is significantly narrower than the drum 10 and the channel 50 has a diameter which is approximately equal to the thickness of the disk 48 at its circumferential edge. The disk operates as the drum 1 in the preferred embodiment.

FIG. 6 shows another alternative embodiment in which a belt 52 having a channel 54 formed in it and into which a wire 56 is fed, melted, and re-solidified as it advances past a heating means 58 as in the preferred embodiment.

The heating means is not limited to a torch. Various heating means may be used, including an electron beam, a plasma beam or induction heating means. There could also be multiple heating means, such as torches, spaced along the path of the precursor wire to either preheat it prior to melting or to increase the length of the "melt region" to insure complete melting of the wire.

The secondary channel 34 shown in FIG. 3 is not limited to having a shape which engages a square sided wire strip only, but may be formed to engage an oval sided or otherwise shaped precursor wire strip.

While FIG. 1 illustrates the formation of the precursor wire by melt overflow as a simultaneous, continuous process in series with formation of the wire, the invention also contemplates separate batch operations. The former method conserves heat energy, but the melt overflow process can be too fast for the wire formation process.

While certain preferred embodiments of the present invention have been disclosed in detail, it is to be understood that various modifications may be adopted without departing from the spirit of the invention or scope of the following claims.

I claim:

1. A wire forming apparatus for forming continuous wire from a continuous, differently shaped cross-section strip, the apparatus comprising:

a) a continuously advancing heat extracting substrate having a channel formed in a surface of the substrate;

b) stock feeding means for continuously feeding a solidified, precursor metal strip into contact with the advancing channel; and c) a heating means spaced from the channel for melting the advancing metal strip in contact with the channel.

2. A wire forming apparatus in accordance with claim 1 wherein the substrate surface and the channel formed in the substrate surface are discontinuous.

3. A wire forming apparatus in accordance with claim 1 wherein the substrate surface and the channel formed int he substrate surface are continuous.

4. A wire forming apparatus in accordance with claim 3 wherein the continuously advancing, heat extracting substrate is a rotating drum.

5. A wire forming apparatus in accordance with claim 3 wherein the continuously advancing, heat extracting substrate is a rotating disc.

6. A wire forming apparatus in accordance with claim 3 wherein the continuously advancing, heat extracting substrate is a conveyor belt.

7. A wire forming apparatus in accordance with claim 1 or 4 wherein the channel is semi-circular in cross-section.

8. A wire forming apparatus in accordance with claim 7 wherein the semi-circular channel further comprises a continuous, secondary, smaller channel, formed in the deepest region of the semi-circular channel, for matingly receiving a portion of the outer surface of the metal strip.

9. A wire forming apparatus in accordance with claim 8 wherein the strip is positioned within the secondary channel in a generally perpendicular orientation to the substrate surface.

10. A wire forming apparatus in accordance with claim 1 wherein the strip is positioned within the channel generally in a perpendicular orientation to the substrate surface.

11. A wire forming apparatus in accordance with claim 1 wherein the heating means comprises a torch.

12. A wire forming method comprising:

a) continuously feeding a solidified precursor metal strip into contact in an advancing channel formed on a surface of a heat extracting substrate at substantially the same velocity as the advancing channel;

b) heating and melting the advancing strip to effect the flow of metal into and support by the channel;

c) resolidifying the molten metal in the channel to form a wire; and d) removing the solidified wire from the heat extracting substrate.

13. A wire forming method in accordance with claim 12 wherein the method further comprises orienting the precursor metal strip, in the advancing channel, perpendicular to the substrate surface.

14. A wire forming method in accordance with claim 12 wherein the method further comprises orienting the precursor metal strip in a secondary, smaller channel formed in the deepest region of the advancing channel, perpendicular to the substrate surface.

15. A wire forming method in accordance with claim 12 wherein the precursor metal strip is first formed by a rapid solidification process comprising contacting a molten pool of metal with a first, rotating, cylindrical, heat extracting substrate, and guiding it from that substrate into the advancing channel.

* * * * *